United States Patent [19]

Hamisch, Jr. et al.

[11] 4,275,654

[45] Jun. 30, 1981

[54] SELECTIVE PRINTING APPARATUS

[75] Inventors: Paul H. Hamisch, Jr., Franklin; Robert M. Pabodie, Dayton, both of Ohio

[73] Assignee: Monarch Marking Systems, Inc., Dayton, Ohio

[21] Appl. No.: 95,848

[22] Filed: Nov. 19, 1979

[51] Int. Cl.[3] ..... B41K 1/12; B41J 1/32

[52] U.S. Cl. ..... 101/110; 101/111

[58] Field of Search ..... 101/110-111, 101/85, 95-97, 99-101, 106-109, 79-83, 75, 59, 14

[56] References Cited

U.S. PATENT DOCUMENTS

| | | | |
|---|---|---|---|
| 3,330,207 | 7/1967 | Deman | 101/92 |
| 3,882,773 | 5/1975 | Cook et al. | 101/110 |
| 3,886,862 | 6/1975 | Hamisch, Jr. | 101/109 |
| 3,908,543 | 9/1975 | Wirth | 101/110 |
| 3,968,745 | 7/1976 | Hamisch, Jr. | 101/111 |
| 3,972,281 | 8/1976 | Sams | 101/110 |
| 4,013,005 | 3/1977 | Keefe | 101/110 |
| 4,055,118 | 10/1977 | Sato | 101/110 |
| 4,084,507 | 4/1978 | Sato | 101/111 X |
| 4,090,442 | 5/1978 | Yazawa et al. | 101/111 |
| 4,149,460 | 4/1979 | Sato | 101/110 |

FOREIGN PATENT DOCUMENTS

| | | | |
|---|---|---|---|
| 2138370 | 2/1973 | Fed. Rep. of Germany | 101/110 |
| 2350537 | 4/1975 | Fed. Rep. of Germany | 101/110 |
| 2603906 | 2/1976 | Fed. Rep. of Germany | 101/110 |

*Primary Examiner*—E. H. Eickholt

*Attorney, Agent, or Firm*—Joseph J. Grass

[57] ABSTRACT

The disclosure relates to a selective printing apparatus adapted to be used in a hand held labeler. The apparatus includes selectively settable printing members driven by wheels coupled by gearing with read wheels for indicating the selected data to be printed. The read and print wheels are driven by a manually movable, shiftable and rotatable selector shaft. The print wheels are detented and the selector shaft is detented within holes in the print wheels. An indicator slidably mounted by a stationary frame is coupled to the selector shaft through a lost-motion connection to enable the print head to move between printing and non-printing positions.

23 Claims, 11 Drawing Figures

SELECTIVE PRINTING APPARATUS

BACKGROUND OF THE INVENTION

1. Field of the Invention

This invention relates to the art of selective printing apparatus.

2. Brief Description of the Prior Art

Various prior art U.S. Pat. Nos. 3,330,207 to De Man dated July 11, 1967; 3,886,862 to Hamisch, Jr. dated June 3, 1975; 3,908,543 to Wirth dated Sept. 30, 1975; 3,968,745 to Hamisch, Jr. dated July 13, 1976; 3,972,281 to Sams dated Aug. 3, 1976; and 4,055,118 to Yo Sato dated Oct. 25, 1977; and West German Offenlegungsschrift No. 2,350,537 are made of record.

SUMMARY OF THE INVENTION

One of the features of the invention is an arrangement for improved detenting in a print head. The wheels are coupled to printing elements which print selected data on a record. As far as the detent is concerned, each wheel could be coupled to a printing member by having the wheels and printing members be one-piece, e.g., a one-piece type wheel as in U.S. Pat. No. 3,908,543, or each wheel could be coupled to a printing member in the form of a printing band which is trained about the wheel and a fixed or movable support as in U.S. Pat. Nos. 3,886,862 and 3,968,745 and West German Offenlegungsschrift 23 50 537. The detenting mechanism for the wheels is disposed in the space within holes in the wheels and preferably a detenting mechanism for a selector shaft is also disposed in the space within the wheel holes. The selector shaft is cooperable with any selected wheel to bring the selected wheel to a position in which a selected printing element is at a printing position. The preferred detenting mechanism for the selector shaft includes a slidably mounted yieldable detent member movable by the selector shaft but with respect to which the selector shaft is rotatable, with the selector shaft being geared to any one of the wheels. The detent member is slidably mounted on slide movable in a slideway.

The preferred detenting mechanism for the wheels includes a helical spring which cooperates with pairs of converging surfaces on the wheels. The wheels are resiliently deformable, so as each wheel is advanced the advancing wheel deforms as one pair of converging surfaces moves out of cooperation with the helical spring toward cooperation with an adjacent pair of converging surfaces.

It is another feature of the invention to provide multi-function members for the read wheel mechanism of the print head. The read wheel or reading section includes a series of read wheels, each read wheel being coupled by gearing to a respective printing member. Each read wheel has a gear which is disposed between and guided by adjacent multi-function members so that the read wheel gears mesh with corresponding print wheel gears. Each multi-function member has a recess for receiving a read wheel gear. The multi-function members partly surround a read wheel and thus serves as a protective shield should the print head on the apparatus of which it forms a part be dropped or otherwise abused. These members provide a transparent portion or window through which indicia of the outer periphery of the read wheels can be viewed. The transparent portion includes an integral lens which magnifies the indicium with which it is registered.

It is another feature of the invention to provide an improved arrangement and method for setting up a print head with print wheels and read wheels in such a way as to avoid the print wheels from being incorrectly coupled to the read wheels or to each other. There are means for orienting the read wheels relative to each other and to the print head frame. There are further means for orienting the print wheels end-to-end with respect to each other. These orienting means insure correct coupling of the read and print wheels.

DETAILED DESCRIPTION OF THE PREFERRED EMBODIMENT

Figures 1, 2, 10, 11:
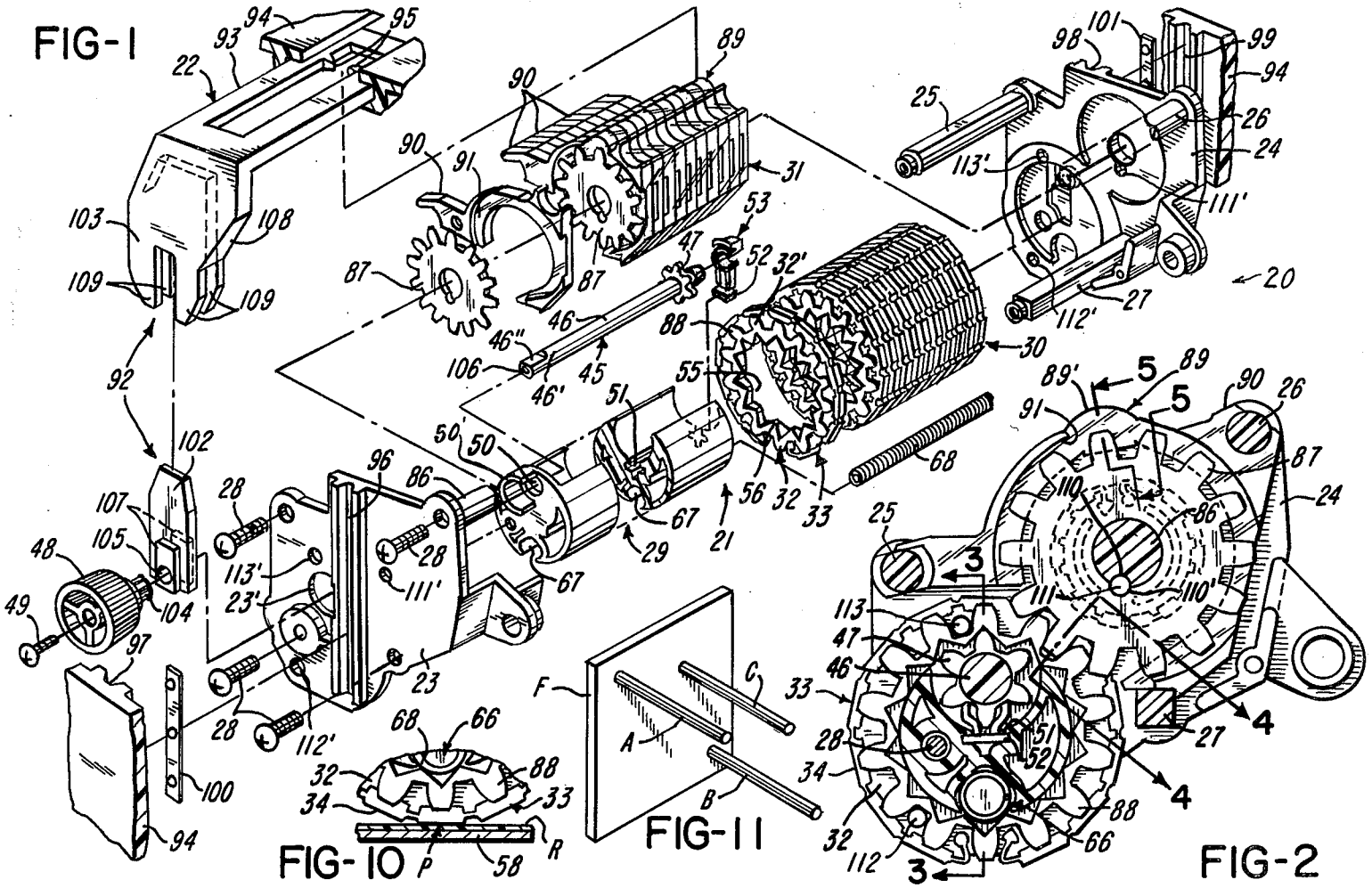
FIG. 1 is a partly exploded perspective view of a print head assembly in accordance with the invention.
FIG. 2 is a sectional view of the assembled print head of the print head assembly.
FIG. 10, which appears on sheet 1, shows the print wheel with one of the printing elements in a printing position adjacent the platen.
FIG. 11 is a perspective view of a fixture.

Referring initially to FIG. 1, there is shown a print head assembly generally indicated at 20 which includes a print head 21 and an indicator mechanism generally indicated at 22. The print head 21 is shown to include a pair of side plates 23 and 24 connected by posts 25, 26 27. Threaded fasteners 28 are received by the respective posts 25, 26 and 27 and one of the fasteners 28 is threadably received by a support generally indicated at 29. The posts 25, 26 and 27 and the support 29 are thus securely connected to the side plates 23 and 24 by the fasteners 28. The print head 21 includes a printing section 30 and a reading section 31. The printing section includes a series of wheels 32 rotatably mounted on the support 29 as best shown in FIG. 2. In the illustrated embodiment, each wheel 32 includes a base 32' (FIG. 7) about the periphery of which a printing member 33 is wrapped. The printing band 33 is shown to have a series of different printing elements 34 so that, for example, characters 0 to 9 and one or more symbols can be printed. The base 32' has a pair of narrow gaps 35 and 36. The gap 35 opens to the periphery of the base 32' and to a socket 37 and the gap 36 opens to the periphery of the base 32' and to a socket 38. Marginal end portions 39 and 40 of the printing member 33 are received in the respective gaps 35 and 36, and lugs 41 and 42 are received in respective sockets 37 and 38. The entries to the sockets 37 and 38 are beveled as shown at 43 and 44 for ease of the insertion of the lugs 41 and 42. The lugs 41 and 42 are considerably wider than the respective gaps 35 and 36 so that the lugs 41 and 42 are captive in the sockets 37 and 38. The printing members 33 are under slight tension so that they are held securely on their respective bases 32'.

Figure 3:
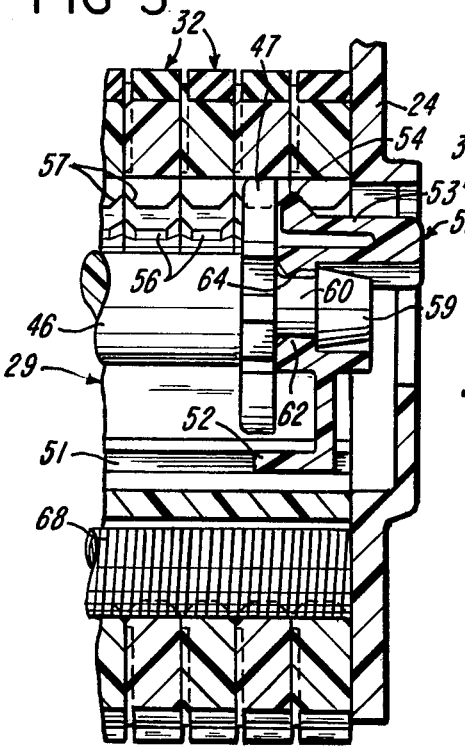
FIG. 3 is a sectional view taken generally along line 3—3 of FIG. 2.
Figure 4:
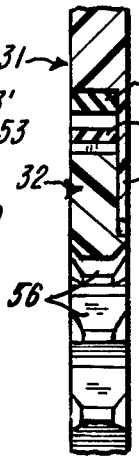
FIG. 4 is a sectional view taken generally along line 4—4 of FIG. 2.
Figure 5:
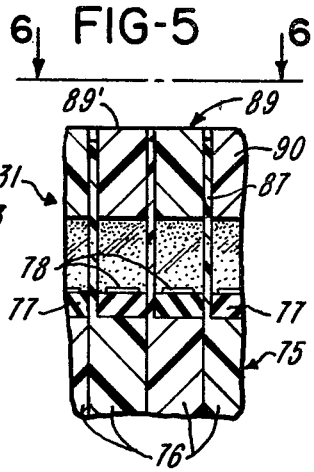
FIG. 5 is a sectional view taken generally along line 5—5 of FIG. 2.
Figure 6:
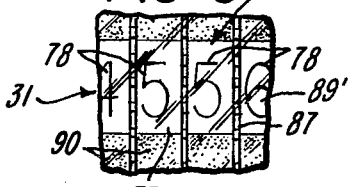
FIG. 6 is a top plan view taken along line 6—6 of FIG. 5.
Figure 9:
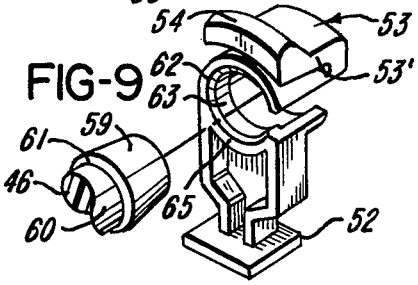
FIG. 9 is a perspective view showing a fragmentary portion of a selector shaft and an associated slide and yieldable detent member.

The wheels 32 are selectively settable. The selection is accomplished by a selector or selector mechanism generally indicated at 45 (FIG. 1) which includes a selector shaft 46 which carries a gear 47 and a manually engageable knob 48 suitably secured thereto as by a threaded fastener 49. The support 29 has an opening or aperature 50 which provides a surface for rotatably supporting the selector shaft 46. The support 29 includes a guideway or slideway 51 which is shown to extend in the lengthwise direction parallel to the axis of the wheels 32. The axis of the selector shaft 46 is also parallel to the axis of the wheels 32. The slideway 51 is shown to slidably mount a slide 52. The slide 52 mounts a yieldable detent member 53. The detent member 53 has a yieldable arm 53' (FIGS. 3 and 9) and a detent tooth 54. A generally central hole 55 in each wheel 32 is defined by an internal gear 56. The internal gear 56 has beveled side edges 57 into which the tooth 54 of the detent member 53 can move. The tooth 54 is shown in FIG. 3 to be detented between adjacent wheels 32 and the gear 47 is shown to be in mesh with a gear 56 of one of the wheels 32. By rotating the selector shaft 46, the wheel gear 56 with which the gear 47 is engaged is driven to bring a different printing element 34 to the printing position P adjacent a platen 58 to print on an intervening record R. The selector shaft 46 can be shifted by either pushing or pulling on the knob 48 to bring the gear 47 into meshing engagement with any one of the other wheel gears 56. The detent member 53 and the slide 52 are connected to the selector shaft 46 as best shown with reference to FIGS. 3 and 9. The selector shaft 46 has an outwardly converging head 59 which merges with a reduced portion 60. The reduced portion 60 is disposed between the head 59 and the gear 47 as shown in FIG. 3. The end of the head 59 adjacent the reduced portion 60 provides a shoulder 61. A socket 62 which is connected to the slide 52 and the detent member 53 provides a rotary connection with the selector shaft 46. The socket 62 has an inwardly extending projection with opposed shoulders 64 and 65. The shoulder 64 abuts the shoulder 61 and the shoulder 65 abuts the side of the gear 47. Thus, the socket 62 is captive between the shoulder 61 and the gear 47 so that the slide 52 and the detent member 53 move together with the selector shaft 46 whenever the selector shaft 46 is shifted. Moreover, the projection 62 is generally annular as is the outer surface of the reduced portion 60 and thus the selector shaft 46 can rotate relative to the slide 52 and to the detent member 53. The socket 62 is shown to be split to enable insertion of the head 59 to the position shown in FIG. 3.

Although the selector mechanism 45 is shown to be used in conjunction with wheels that print, this selector mechanism 45 could also be used in conjunction with wheels that drive print bands about a support as in U.S. Pat. No. 3,968,745 or in conjunction with wheels that drive print wheels, for example.

Figure 7:
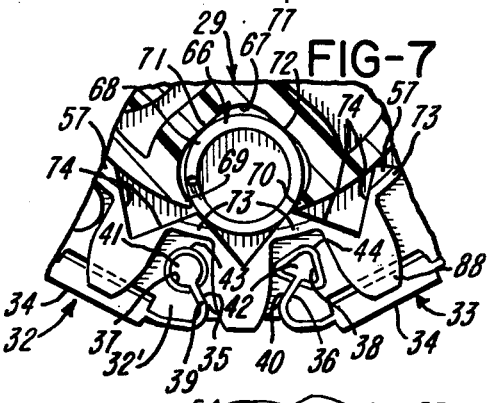
FIG. 7 is a fragmentary sectional view of a print wheel.

The wheels 32 are shown to be detented in any selected position by a detent mechanism generally indicated at 66. The support 29 also includes a recess 67 which extends in the lengthwise direction parallel to the axis of the wheels 32. The recess 67 is shown to open to the outer periphery of the support 29. The recess 67 receives a detent member in the form of a helical spring 68. The spring 68 is preferably of one-piece construction so that it contacts and is common to all the wheels 32. The recess 67 is contoured so that the spring 68 is contacted and supported in the recess at four locations 69, 70, 71 and 72 and extends beyond the periphery of the support 29. The spring 68 is essentially non-deformable, whereas the wheels 32 deform resiliently when indexed. The turns of the spring 68 are tightly wound as best shown in FIG. 3 and preferably the spring 68 is composed of metal, specifically small diameter wire. The wire diameter is less than the thickness of a wheel 32. The bases 32' of the wheels 32 are composed of plastics material which is resiliently deformable when a wheel 32 is indexed. The internal gear 56 has teeth 73 defined by pairs of converging surfaces 74. In a detented position as shown in FIGS. 7 and 10 for example, the spring 68 is shown to be in contact with both converging surfaces 74 of a pair. Each pair of converging recesses 74 provides a recess. When a wheel 32 is advanced, one pair of converging surfaces 74 leaves contact with the spring 68 and an adjacent pair of converging surfaces 74 are cammed into cooperation with the spring 68 by the spring 68 as the wheel returns to its original shape.

Figure 8:
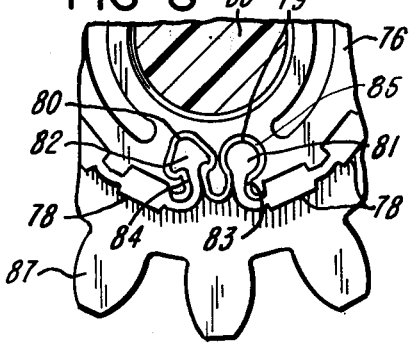
FIG. 8 is a fragmentary sectional view of a read wheel.

The reading wheel section 31 is shown to include a series of read wheels 75. The read wheels 75 have generally annular bases 76 about which bands 77 are wrapped. The bands 77 have human readable indicia 78 corresponding to the printing elements 34 on the wheels 32. The base 76 (FIG. 8) of each wheel 75 has a pair of sockets 79 and 80 for receiving respective lugs 81 and 82. A narrow gap 83 opens into the socket 79 and to the outer periphery of the base 76 and a narrow gap 84 opens into the socket 80 and into the outer periphery of the base 76. The gaps 83 and 84 are narrower than respective lugs 81 and 82 so that the lugs 81 and 82 are held captive in respective sockets 79 and 80. There is a continuous bevel 85 in the side of the base 76 adjacent the sockets 81 and 82 and the gaps 83 and 84 to facilitate insertion of the lugs 81 and 82. The bases 76 are shown to be rotatably mounted on a post or shaft 86. A gear 87 is connected to each wheel 75 and is preferably molded integrally with the base 76. Each gear 87 meshes with a gear 88 which is connected to a respective wheel 32. The gear 88 is preferably molded integrally with respective base 32'. When the selector shaft 46 is rotated, the gear 88 associated with the selected wheel 32 drives a meshing gear 87 of a respective read wheel 75. The user can observe which printing elements 34 are at the printing position P by looking through transparent portions or windows 89 of respective members 90. Each member 90 has a plurality of functions. Each member 90 is preferably molded from plastics material. The surface of each member 90 is matte or non-transparent except for the window 89, the outer surface of which is arched to provide a lens 89'. The lenses 89' provide some magnification of indicia 78 on the read wheels 75.

The members 90 have recesses 91 which have a depth substantially equal to the width or thickness of the gear 87 which they guide. The members 90 are arranged in a stack so that the gears 87 are trapped between adjacent members 90. Each member 90 has the same width (except for clearance) as an associated wheel 32 and it is apparent that the members 90 guide the gears 87 for rotation in respective paths in alignment with respective meshing gears 88. The members 90 also serve as shields to prevent damage to the gears 87 in the event the print head or the labeler or other printing apparatus of which it forms a part should be dropped or otherwise abused.

While the user can visually observe the printing elements which are at the printing position by peering through the window 89, the user is informed as to the particular wheel 32 with which the selector shaft 46 is coupled by means of the indicator mechanism 22. The indicator mechanism 22 is connected to the print head 21 by a connection generally indicated at 92 which enables the print head 21 to move into and out of printing cooperation with the platen 58, while an indicator 93 is only slidable relative to a fixed frame 94. The indicator 93 is slidable in a track parallel to the direction of shifting movement of the selector shaft 46. The indicator 93 includes a pair of opposed pointers 95 which are aligned with the gear 47 of the selector 45 and with the respective read wheel 75 at the window 89. The print head 21 is guided for back and forth movement by two pairs of opposed ball tracks 96 and 97, and 98 and 99. The ball tracks 97 and 99 are considered to be part of the frame 94. Ball bearing strips 100 and 101 are disposed between respective ball tracks 96 and 97, and 98 and 99. The connection 92 is more particularly a lost-motion connection. Specifically, the connection between the print head 21 and the indicator 93 includes a pair of telescoping members 102 and 103. The member 102 is connected to the selector shaft 46. A tubular projection 104 on the knob 48 extends into a hole 105 in the member 102. The screw 49 extends through the knob 48 and into its tubular projection 104 and is threadably received by a hole 106 in the selector shaft 46. The member 102 is free to pivot on the projection 104. The opposite sides of the member 102 are provided with guide members or lugs 107. The indicator 93 has a depending, essentially hollow member 108 having four spaced apart projections 109. The member 102 is telescopically received in the member 108. Each guide member 107 slides in slidable relationship between two respective pairs of the projections 109. The guide members 107 are in constant guided relationship with the projections 109 irrespective of whether the print head 21 is in the printing position or is in the non-printing position in which the print head 21 is spaced from the platen 58. Notwithstanding the fact that the print head 21 moves between the printing and non-printing positions, the indicator mechanism 22 remains coupled with the print head 21 and in particular remains coupled with the selector shaft 46.

The shaft 86 has an axially extending groove 110 which is shown to semi-circular, and each wheel base 76 has a groove or opening 110' which is shown to be semi-circular. When the grooves 110 and 110' are aligned they form a locating hole or opening 111. Each wheel has holes or openings 112 and 113 angularly spaced apart by other than 180°. In assembling the print head 21, the support 29 is connected to the side plate 23 by a screw 28. When the support 29 is connected to the side plate 23, arcuate projection 50', which partially surrounds the axis of the hole 50, fits snugly into a hole 23' in the side plate 23. Thereupon, side plate 23 is placed in a fixture F with pins A, B and C sticking through respective holes or openings 111', 112' and 113' in the side plate 23. The side plate 24 also has corresponding aligned holes 111', 112' and 113'. A wheel 32 and a corresponding read wheel 75 are assembled in pairs onto respective supports 29 and 86. The wheels 32 and 75 can only be assembled one way because of the pins A, B and C. Specifically the pin A extends through the holes 111' (in side plate 23) and 111, the pin B extends through holes 112' and 112, and pin C extends through holes 113' and 113. As indicated above, the printing members 33 can only be assembled onto the respective wheels 32 one way, and the bands 77 can only be assembled onto the respective bases 76 one way. Each wheel 76 could be provided with an additional aligning hole disposed at an angular position of other than 180° from the notch 110' but the same result can be obtained by observing that each gear 88 must be spaced from the adjacent gear or gears. Thus, if two gears 88 are in face-to-face contact, then one of contacting gears 88 is turned the wrong way. When all the wheels 32 and 75 are properly aligned, the readable indicia 34 are all in a straight row showing blanks and the blank positions of labels 32 are at the printing position as shown in FIG. 2 for example. When all the wheels 32 and 75 are assembled, the selector shaft 46, coupled to the slide 52 and to the detent member 53, is inserted into the space within the wheels 32 with its end portion 46' extending a short distance through hole 23'. When thus positioning the selector shaft 46, the slide 52 is inserted through the end of the slideway 51. In this position of the selector shaft 46, the member 102 can be slid onto the projection 104 and the knob 48 can be slipped over the end portion 46' so that flat 46'' complements a corresponding flat (not shown) on the knob 48. The knob 48 is thus non-rotatably connected to the shaft 46 and the screw 49 keeps the knob 48 from slipping off the shaft 46. The screw 49 also spreads the projection 104 which is split to prevent the connector 102 from shifting axially on the projection. Thereafter the side plate 24 is connected to the side plate 23 by the rest of the screws 28.

With the exception of the metal screws 28 and 49, the metal ball bearing strips 100 and 101, the metal spring 68, and the bands 33 and 77 which are composed of elastomeric material, the entire assembly 20 is composed of moldable plastics material. The one-piece element which comprises the slide 52, the detent member 53 and the socket 62 is constructed of a material that is sufficiently flexible and resilient to enable the arm 53' to flex as the selector shaft 46 is shifted axially and to enable the socket 62 to open to receive the head 59 during assembly. Also the entire shaft 46 and the gear 47 are molded as one piece.

While it is preferred to detent the selector 46 and the wheels 32 in the space within wheels 32, in another embodiment (not shown) the detenting of both the selector 46 and read wheels 75 is accomplished in the space within the read wheels 75.

Other embodiments and modifications of this invention will suggest themselves to those skilled in the art, and all such of these as come within the spirit of this invention are included within its scope as best defined by the appended claims.

We claim:

1. For a printer: a platen, a series of wheels, a plurality of different printing elements for each wheel, the wheels being settable to bring one of the printing elements to a printing position adjacent the platen, each wheel being elastically deformable and having an internal gear defining a generally central hole, the internal gear having a series of gear teeth, the space between adjacent teeth being defined by a pair of converging surfaces, a selector shaft having a gear selectively engageable with the gear teeth of any wheel, and a helical spring cooperable with one of the pairs of converging surfaces of each wheel for detenting the wheels, wherein the helical spring cooperates with the pairs of inclined surfaces of the wheels to cam the selected printing element to the printing position.

2. The invention as defined in claim 1, wherein the spring is of one-piece construction.

3. The invention as defined in claim 1, wherein the spring is composed of metal and the wheels are composed of plastics material at least at the places where the wheels contact the helical spring.

4. The invention as defined in claim 1, including a support received in the wheel holes for rotatably supporting the wheels, and means providing a recess in the support for mounting the helical spring.

5. For a printer: a platen, a series of wheels, a plurality of different printing elements for each wheel, the wheels being settable to bring one of the printing elements to a printing position adjacent the platen, each wheel being elastically deformable and having a series of internal recesses corresponding to the printing elements, a helical spring for contacting the wheels at the recesses to effect detenting of the wheels with the selected printing elements at the printing position, and wherein each wheel deforms elastically while being set.

6. The invention as defined in claim 5, wherein the spring is composed of wound wire have a diameter substantially less than the thickness of a wheel, and wherein the helical spring is tightly wound.

7. A print head, comprising: a series of print wheels each having a series of different printing elements for printing selected data, a series of read wheels each having human readable indicia corresponding to the respective printing elements, each print wheel having a gear, each read wheel having a gear meshed with a respective print wheel gear, and members disposed between adjacent read wheel gears for guiding the read wheel gears in meshing engagement with the print wheel gears, each member having a transparent area for enabling the human readable indicia to be read, each member having a recess for receiving a respective read wheel gear, each member including an arcuate portion spaced from and at least partially surrounding the respective read wheel.

8. A print head as defined in claim 7, wherein the transparent area of each member is disposed between a pair of non-transparent areas, each transparent area including an integral magnifying lens through which an indicium in the respective read wheel can be read.

9. For a printer: a platen, a series of settable wheels, a series of different printing elements for each wheel, the wheels being settable to bring one of the printing elements to a printing position adjacent the platen, each wheel being elastically deformable and having an internal gear defining a generally central hole, the internal gear having a series of gear teeth, the space between adjacent teeth being defined by a pair of converging surfaces, a selector shaft having a gear selectively engageable with the gear teeth of any wheel, means cooperable with one of the pairs of converging surfaces of each wheel for detenting the wheels at the printing position, wherein the wheel detenting means cooperates with the pairs of inclined surfaces of the wheels to cam the selected printing element to the printing position, and means disposed in space defined by the wheel holes for detenting the selector shaft in engagement with the internal gear of any selected wheel.

10. For a printer: a platen, a series of settable wheels, a series of different printing elements for each wheel, the wheels being settable to bring one of the printing elements to a printing position adjacent the platen, each wheel being elastically deformable and having an internal gear defining a generally central hole, the internal gear having a series of gear teeth, the space between adjacent teeth being defined by a pair of converging surfaces, a selector shaft having a gear selectively engageable with the gear teeth of any wheel, means cooperable with one of the pairs of converging surfaces of each wheel for detenting the wheels at the printing position, wherein the wheel detenting means cooperates with any one of a plurality of the pairs of inclined surfaces of the wheels to cam the selected printing element to the printing position, means including a slidably mounted yieldable detent member disposed in space defined by the wheel holes for detenting the selector shaft in engagement with the internal gear of any selected wheel, and means for rotatably connecting the detent member and selector shaft.

11. The invention as defined in claim 10, wherein the wheel detent means includes a one-piece member in contact with the wheels.

12. For a printer: a platen, a plurality of axially aligned wheels, a plurality of printing bands each having a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means including a metal helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, the wheels being composed of plastics material at least at the places where the wheels contact the helical spring, and wherein the bands are resiliently deformable when the selected wheel is rotated relative to the support.

13. For a printer: a platen, a plurality of axially aligned wheels, a plurality of printing bands each having a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means including a metal helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, wherein the recesses in the wheels have inclined surfaces cooperable with the helical spring to cam the selected printing elements to the printing position, the wheels being composed of plastics material at least at the places where the wheels contact the helical spring, and wherein the bands are resiliently deformable when the selected wheel is rotated relative to the support.

14. For a printer: a platen, a plurality of axially aligned wheels, a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means including a metal, essentially non-deformable, helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, and the wheel being composed of plastics material at least at the places where the wheels contact the helical spring.

15. For a printer: a platen, a plurality of axially aligned wheels, a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means including a metal helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, wherein the recesses in the wheels have inclined surfaces cooperable with the helical spring to cam the selected printing element to the printing position, and the wheels being composed of plastics material at least at the places where the wheels contact the helical spring.

16. The invention as defined in any one of claims 15 through 13, wherein the helical spring is essentially non-deformable.

17. For a printer: a platen, a plurality of axially aligned wheels, a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means comprising a metal helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, and the wheels being composed of plastics material at least at the places where the wheels contact the helical spring.

18. The invention as defined in any one of claims 17 through claim 14, wherein the support is received in the continuous opening.

19. The invention as defined in any one of claims 17 through 14, where the helical spring is of one-piece construction.

20. The invention as defined in any one of claims 17 through 14 wherein the support is received in the continuous opening, the recess in the support for the helical spring is undercut, and the recesses in the wheels are disposed at their inner peripheries.

21. The invention as defined in any one of claims 17 through 14, wherein the helical spring is composed of wound wire having a diameter substantially less than the thickness of a wheel, and wherein the helical spring is tightly wound.

22. For a printer: a platen, a plurality of axially aligned wheels, a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means comprising a helical spring for detenting the wheels, means providing a recess in the support, the recess in the support having an open side, and the helical spring being disposed in the recess in the support and projecting beyond the open side into the recesses in the wheels to detent the wheels and align selected printing elements at the printing zone.

23. For a printer: a platen, a plurality of axially aligned wheels, a plurality of different printing elements coupled to each wheel, a support for rotatably supporting the wheels, the wheels having holes defining a continuous opening, an axially shiftable and rotatable selector disposed in the continuous opening for engaging and rotating any selected wheel to bring a selected printing element to a printing zone adjacent the platen, the wheels having means providing a series of recesses, means including a helical spring for detenting the wheels, means providing a recess in the support, the recess in the support having an open side, the helical spring being disposed in the recess in the support and projecting beyond the open side into the recesses in the wheels to detent the wheels and align selected printing elements at the printing zone, and wherein the recesses in the wheels having inclined surfaces cooperable with the helical spring to cam the selected printing element to the printing position.

* * * * *

UNITED STATES PATENT AND TRADEMARK OFFICE

CERTIFICATE OF CORRECTION

PATENT NO. : 4,275,654

DATED : June 30, 1981

INVENTOR(S) : Paul H. Hamisch, Jr. and Robert M. Pabodie

It is certified that error appears in the above-identified patent and that said Letters Patent are hereby corrected as shown below:

Column 9, claim 16, lines 38 and 39, "15 through 13" should be --12, 13 and 15--. Column 10, claim 18, lines 4 and 5, "17 through 14" should be --12, 13, 14, 15 and 17--; claim 19, lines 7 and 8, "17 through 14" should be --12, 13, 14, 15 and 17--; claim 20, lines 10 and 11, "17 through 14" should be --12, 13, 14, 15 and 17--; claim 21, lines 15 and 16, "17 through 14" should be --12, 13, 14, 15 and 17--. Claim 22, lines 20 and 21, "aligned" has been misspelled.

Signed and Sealed this

*Sixth* Day of *October 1981*

[SEAL]

*Attest:*

GERALD J. MOSSINGHOFF

*Attesting Officer*

*Commissioner of Patents and Trademarks*